US011324381B2

(12) United States Patent
Büsing et al.

(10) Patent No.: US 11,324,381 B2
(45) Date of Patent: May 10, 2022

(54) DISH WASHER

(71) Applicant: SAMSUNG ELECTRONICS CO., LTD., Suwon-si (KR)

(72) Inventors: Johannes Büsing, Suwon-si (KR); Chang Wook Lee, Suwon-si (KR); Ji Sun Yang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 135 days.

(21) Appl. No.: 16/712,115

(22) Filed: Dec. 12, 2019

(65) Prior Publication Data

US 2020/0187748 A1 Jun. 18, 2020

(30) Foreign Application Priority Data

Dec. 12, 2018 (KR) ..... 10-2018-0160323

(51) Int. Cl.
*A47L 15/42* (2006.01)

(52) U.S. Cl.
CPC ..... *A47L 15/4221* (2013.01); *A47L 15/4217* (2013.01)

(58) Field of Classification Search
CPC ..... A47L 15/4221; A47L 15/4217
See application file for complete search history.

(56) References Cited

U.S. PATENT DOCUMENTS 5,664,733 A 9/1997 Lott
8,978,674 B2 3/2015 Büsing et al.
9,027,578 B2 5/2015 Boyer et al.
9,931,015 B2 4/2018 Luciano et al.
2010/0236588 A1 9/2010 Büsing et al.
(Continued)

FOREIGN PATENT DOCUMENTS

CH 571852 A5 1/1976
JP 9-327432 12/1997
(Continued)

OTHER PUBLICATIONS

International Search Report dated Apr. 16, 2020 from International Application No. PCT/KR2019/017581, 3 pages.
(Continued)

*Primary Examiner* — Benjamin L Osterhout
(74) *Attorney, Agent, or Firm* — Staas & Halsey LLP

(57) ABSTRACT

A dish washer including: a main body; a tub; a basket configured to receive dishes; a first sprayer and a second sprayer configured to spray water toward the basket; a circulating pump configured to circulate water; and an alternating device configured to provide water from the circulating pump to at least one of the first sprayer or the second sprayer, wherein the alternating device includes a housing including a communicating portion to receive water, and a distributor rotatably positioned inside the housing and formed in the shape of a cylinder, and the distributor includes an inlet portion corresponding to the communicating portion, and at least one distributing hole formed in an outer circumference of the distributor, providing water to at least the one sprayer or the second sprayer, and a guide positioned inside of the distributor including a curved surface for guiding water to the at least one distributing hole.

20 Claims, 9 Drawing Sheets

(56) References Cited

U.S. PATENT DOCUMENTS

| | | | | |
|---|---|---|---|---|
| 2010/0269866 | A1* | 10/2010 | Froelicher | A47L 15/23 134/104.4 |
| 2014/0182625 | A1* | 7/2014 | Lee | A47L 15/4221 134/18 |
| 2016/0215893 | A1* | 7/2016 | Riddle | A47L 15/4221 |
| 2017/0356120 | A1 | 12/2017 | Choi et al. | |
| 2019/0246869 | A1* | 8/2019 | Johannes | A47L 15/4282 |

FOREIGN PATENT DOCUMENTS

| | | | |
|---|---|---|---|
| KR | 10-0176945 | B1 | 11/1998 |
| KR | 10-2015-0054610 | | 5/2015 |
| KR | 10-2017-0046466 | | 5/2017 |
| KR | 10-2018-0025761 | | 3/2018 |
| WO | 2018/043898 | A1 | 3/2018 |
| WO | 2018043898 | A1 | 3/2018 |

OTHER PUBLICATIONS

Extended European Search Report dated Feb. 18, 2020 from European Application No. 19215635.4 with modified Abstract, 8 pages.

* cited by examiner

DISH WASHER

CROSS-REFERENCE TO RELATED APPLICATION

This application is based on and claims priority under 35 U.S.C. § 119 to Korean Patent Application No. 10-2018-0160323, filed on Dec. 12, 2018 in the Korean Intellectual Property Office, the disclosure of which is incorporated by reference herein in its entirety.

BACKGROUND

1. Field

The disclosure relates to a dish washer, and more particularly, to a dish washer having an improved alternating device.

2. Description of the Related Art

A dish washer is an appliance for automatically washing off food residues, etc. on dishes with a detergent and washing water.

A dish washer includes a main body, a tub positioned inside the main body, an accommodating container positioned inside the tub to accommodate dishes, and a spray unit (sprayer) for spraying washing water toward the accommodating container.

Generally, two or three accommodating containers are provided in a two-story or three-story structure, wherein a plurality of spraying units for spraying washing water are arranged around the individual accommodating containers to correspond to the accommodating containers.

The dish washer includes an alternating device for distributing washing water to provide the washing water to the plurality of spraying units.

Washing water is distributed to different directions inside the alternating device and provided to the plurality of spraying units. When the flow direction of washing water changes, flow velocity loss occurs, resulting in a deterioration of efficiency.

SUMMARY

Therefore, it is an aspect of the disclosure to provide a dish washer capable of improving efficiency of an alternating device by effectively guiding washing water inside the alternating device.

Additional aspects of the disclosure will be set forth in part in the description which follows and, in part, will be obvious from the description, or may be learned by practice of the disclosure.

In accordance with an aspect of the disclosure, there is provided a dish washer including: a main body; a tub positioned inside the main body; a basket positioned inside the tub and storing dishes; a spray unit including a first spray unit and a second spray unit configured to spray washing water to wash the dishes stored in the basket; a circulating pump configured to circulate washing water; and an alternating device configured to provide washing water circulating by the circulating pump to at least one of the first spray unit or the second spray unit, wherein the alternating device includes a housing including a communicating portion communicating with the circulating pump to receive washing water, and a distributor rotatably positioned inside the housing and formed in the shape of a cylinder, and the distributor includes an inlet portion positioned in one side of the distributor and corresponding to the communicating portion of the housing, a distributing hole formed in an outer circumference of the distributor and providing washing water to the spray unit, and a guide positioned in the other side of the distributor and including a curved surface for guiding washing water to the distributing hole.

The guide may be formed in a concave shape with respect to a direction in which the inlet portion opens.

The distributing hole may include a first distributing hole providing washing water to the first spray unit, and a second distributing hole providing washing water to the second spray unit, and at least one portion of the curved surface of the guide is connected to the second distributing hole such that the guide guides washing water to the second distributing hole.

One end of the curved surface of the guide may be connected to an inner circumference surface of the distributor, and the other end of the curved surface may be connected to the second distributing hole.

The alternating device may further include a motor configured to rotate the distributor, and the distributor may be rotatable on a rotation axis extending in a direction in which the communicating portion opens, and further include a rotating portion positioned outside the guide portion in a direction of the rotation axis and coupled to the motor to rotate the distributor.

The distributing hole may include a first distributing hole providing washing water to the first spray unit, and a second distributing hole providing washing water to the second spray unit, the housing may include a cylinder portion, a first outflow portion disposed at an outer circumference of the cylinder portion and selectively communicating with the first distributing hole, and a second outflow portion disposed at the outer circumference of the cylinder portion and selectively communicating with the second distributing hole, and the communicating portion may be positioned at one end of the cylinder portion.

The communicating portion may be orthogonal to the first outflow portion or the second outflow portion.

The first outflow portion may be closer to the communicating portion than the second outflow portion and opposite to the second outflow portion with respect to the cylinder portion.

The spray unit may further include an auxiliary spray unit configured to spray washing water, and the housing may further include a third outflow portion providing washing water to the auxiliary spray unit and disposed at the outer circumference of the cylinder portion.

The third outflow portion may be positioned on the same line as the second outflow portion in a diameter direction of the cylinder portion with respect to the rotation axis.

The second distributing hole may include an extension portion extending in a circumference direction of the cylinder portion from a circumference of the second distributing hole.

The guide portion may further include an auxiliary guide portion guiding washing water such that the washing water is discharged to the third outflow portion through the extension portion.

The guide may guide washing water entered through the inlet portion such that the washing water is discharged to the third outflow portion through the second distributing hole.

The housing may include a connection portion being opposite to the communicating portion and including an opening such that the motor is connected to the rotating portion.

In accordance with another aspect of the disclosure, there is provided an alternating device configured to supply washing water to at least one of a first spray unit or a second spray unit configured to spray washing water, the alternating device including: a housing including a communicating portion opening in a first direction to receive washing water, a first outflow portion opening in a second direction that is orthogonal to the first direction to discharge washing water to the first spray unit, and a second outflow portion opening in the second direction that is orthogonal to the first direction to discharge washing water to the second spray unit; and a distributor rotatably positioned inside the housing and providing washing water to at least one of the first outflow portion or the second outflow portion, wherein the distributor includes an inlet portion formed in one side of the distributor and corresponding to the communicating portion, a distributing hole overlapping with at least one of the first outflow portion or the second outflow portion by a rotation of the distributor, and a guide formed in the other side of the distributor and guiding washing water entered through the inlet portion to the distributing hole.

The distributing hole may open in the second direction, and the guide may include a curved surface extending from the first direction to the second direction to guide washing water entered in the first direction toward the second direction.

The housing may further include a third outflow portion opening in a third direction that is an opposite direction of the second direction to discharge washing water, and the curved surface of the distributor may guide the washing water entered in the first direction toward the third direction.

The third outflow portion may be positioned on the same line as the second outflow portion in a diameter direction of the of the distributor.

The distributor may be formed in the shape of a cylinder, the distributing hole may include a first distributing hole formed in an outer circumference of the distributor and positioned at a location corresponding to the first outflow portion for a predetermined time when the distributor rotates, and a second distributing hole positioned at a location corresponding to at least one of the second outflow portion or the third outflow portion for a predetermined time when the distributor rotates.

In accordance with another aspect of the disclosure, there is provided a distributor of an alternating device configured to selectively distribute washing water to a plurality of distributing units, the distributor rotating on a rotation axis extending in a first direction, the distributor including: an inlet portion formed in one side of the distributor with respect to the first direction and opening in the first direction to receive washing water; a distributing hole opening in a second direction that is orthogonal to the first direction and distributing washing water to at least one spray unit of the plurality of spray units; and a guide positioned in the other side of the distributor that is opposite to the inlet portion with respect to the first direction, and including a curved surface extending from the first direction to the second direction to guide washing water entered in the first direction toward the second direction.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, embodiments of the disclosure will be described in detail with reference to the accompanying drawings. Meanwhile, the terms used in the following description "front end", "rear end", "upper portion", "lower portion", "upper end", and lower end", and the like are defined based on the drawings and the shape and position of each component are not limited by these terms.

In the following description, dishes are used as a concept including bowls, cups, cutlery, various cooking tools, etc.

Hereinafter, "X" indicates a front-back direction of a dish washer 1, and "Y" indicates a left-right direction of the dish washer 1. Also, "H" indicates a height direction of the dish washer.

Throughout the disclosure, the expression "at least one of a, b or c" indicates only a, only b, only c, both a and b, both a and c, both b and c, all of a, b, and c, or variations thereof.

Figure 1:
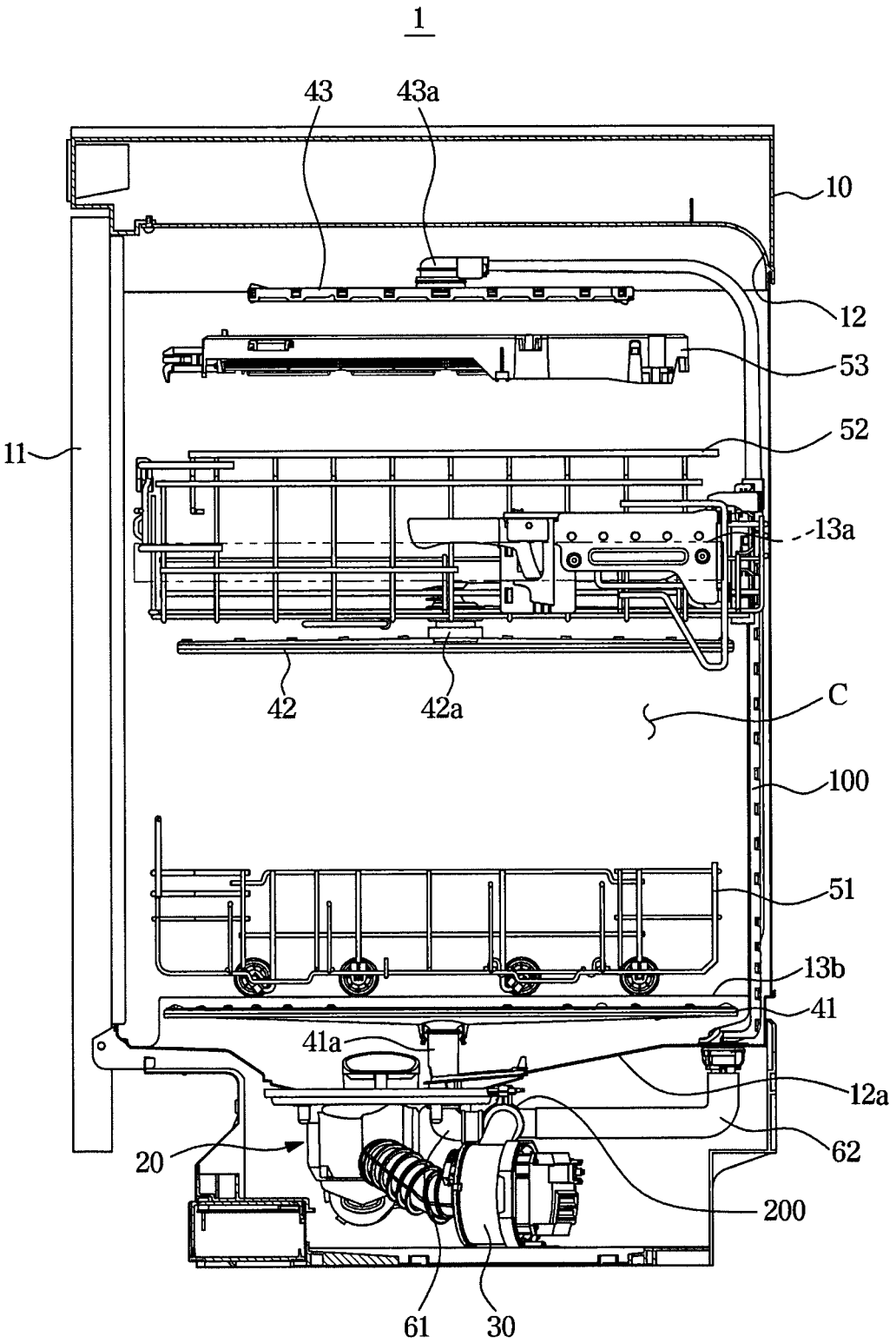
FIG. 1 is a cross-sectional view of a dish washer according to an embodiment of the disclosure.
Figure 2:
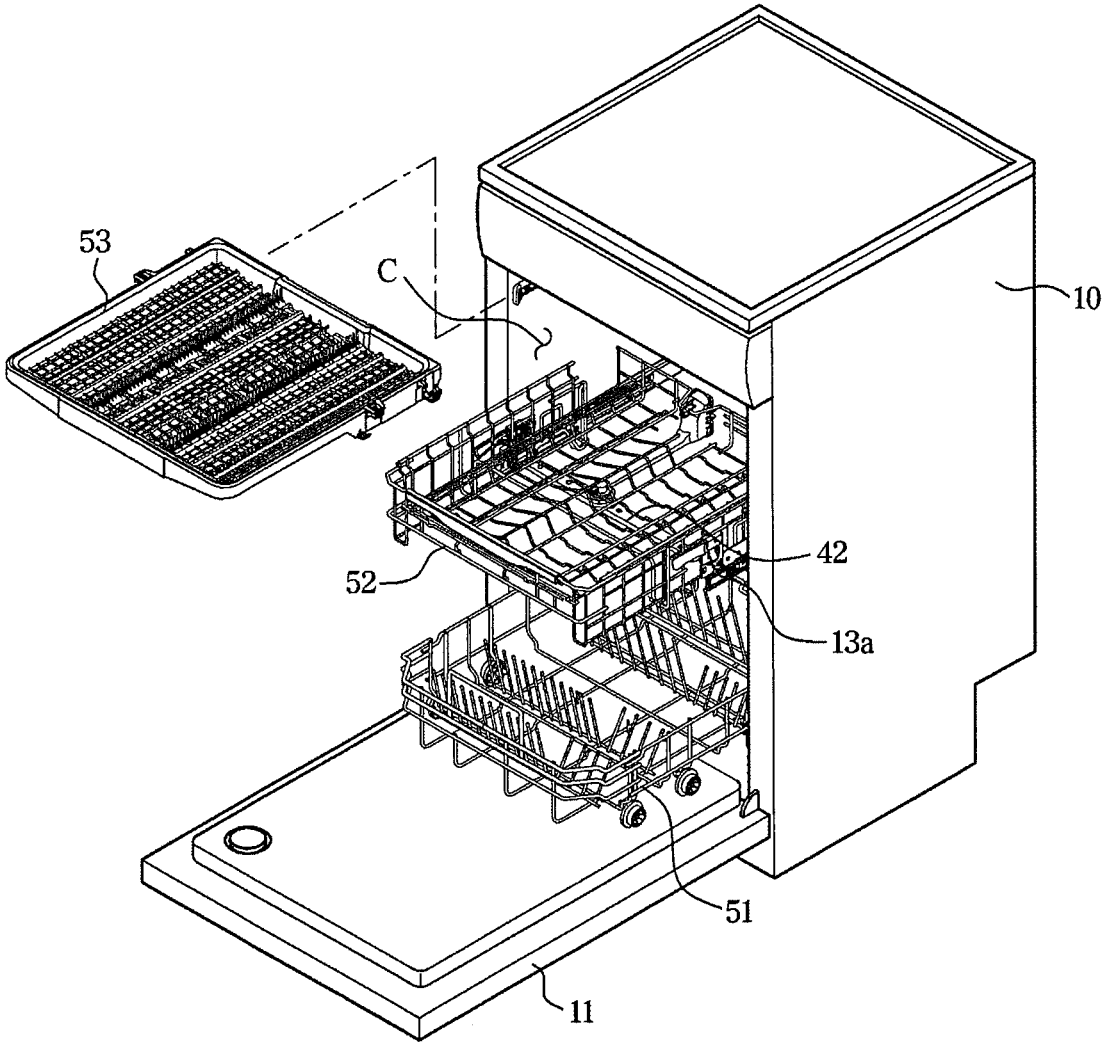
FIG. 2 is a perspective view of a dish washer according to an embodiment of the disclosure.

FIG. 1 is a cross-sectional view of a dish washer according to an embodiment of the disclosure, and FIG. 2 is a perspective view of the dish washer according to an embodiment of the disclosure.

As shown in FIGS. 1 and 2, the dish washer 1 may include a main body 10 forming an outer appearance.

The dish washer 1 may further include a tub 12 positioned inside the main body 10. The tub 12 may be in the shape of substantially a box. One side of the tub 12 may open. That is, the tub 12 may include an open side 12*a*. For example, a front side of the tub 12 may open.

The dish washer 1 may further include a door 11 for opening and closing the open side 12*a* of the tub 12. The door 11 may be mounted on the main body 10 to open and close the open side 12*a* of the tub 12. The door 11 may be rotatably mounted on the main body 10.

The dish washer 1 may further include an accommodating container positioned inside the tub 12 to accommodate dishes.

The accommodating container may include a plurality of baskets 51, 52, and 53. In the plurality of baskets 51, 52, and 53, dishes of relatively large volumes may be accommodated. However, kinds of dishes that are accommodated in the plurality of baskets 51, 52, and 53 are not limited to dishes of relatively large volumes. That is, in the plurality of baskets 51, 52, and 53, dishes of relatively small volumes, as well as dishes of relatively large volumes, may also be accommodated.

The plurality of baskets 51, 52, and 53 may include a middle basket 52 located at a middle area in the height direction of the dish washer 1, and a lower basket 51 located at a lower area in the height direction of the dish washer 1. The middle basket 52 may be supported on a middle guide rack 13*a*, and the lower basket 51 may be supported on a lower guide rack 13*b*. The middle guide rack 13*a* and the lower guide rack 13*b* may be mounted on an inner wall 14 of the tub 12 such that the middle basket 52 and the lower basket 51 slide on the middle guide rack 13*a* and the lower guide rack 13*b*, respectively, toward the open portion 12*a* of the tub 12. The inner wall 14 of the tub 12 may include inner surfaces of right and right walls of the tub 12.

The accommodating container may include an upper basket 53 located at an upper area in the height direction of the dish washer 1. The upper basket 53 may be formed in the shape of a rack assembly to accommodate dishes of relatively small volumes. In the upper basket 53, cooking tools, such as a ladle, a knife, a spatula, and the like, and cutlery may be accommodated. Also, in the rack assembly, a small cup such as an espresso cup may be accommodated. However, kinds of dishes that are accommodated in the upper basket 53 are not limited to the above-mentioned examples.

Also, the upper basket 53 may be omitted according to a size of the tub 12. That is, the accommodating container may be configured with the middle basket 52 and the lower basket 51.

The dish washer 1 may further include a sump 20 for collecting and storing washing water. The dish washer 1 may include a washing chamber C corresponding to an inside space of the tub 12.

The washing chamber C may be a space in which dishes accommodated in the baskets 51, 52, and 53 are washed by washing water and dried. The washing chamber C may be sealed to prevent washing water circulating inside the washing chamber C from leaking to an outside of the washing chamber C through other components except for the washing chamber C and the sump 20.

The dish washer 1 may further include a spray unit (sprayer) configured to spray washing water. The spray unit may include a first spray unit (sprayer) 41 located below the lower basket 51 in the height direction of the dish washer 1, a second spray unit (sprayer) 42 located below the middle basket 52 in the height direction of the dish washer 1, and a third spray unit (sprayer) 43 located above the upper basket 53 in the height direction of the dish washer 1.

The first spray unit 41 may be rotatable on a rotating shaft 41*a*, the second spray unit 42 may be rotatable on a rotating shaft 42*a*, and the third spray unit 43 may be rotatable on a rotating shaft 43*a*.

However, the first spray unit 41 may be fixed to one side of a lower area of the washing chamber C, unlike the second spray unit 42 and the third spray unit 43. In this case, the first spray unit 41 may spray washing water in a substantially horizontal direction through a fixed nozzle, and washing water sprayed in the horizontal direction through the nozzle of the first spray unit 41 may change its direction by a turning assembly positioned inside the washing chamber C to be sprayed upward. The turning assembly may be mounted on a rail by a holder to horizontally move along the rail.

The third spray unit 43 may spray washing water toward dishes accommodated in the upper basket 53 and the middle and lower baskets 52 and 51, and the second spray unit 42 may spray washing water toward dishes accommodated in the middle basket 52 and the upper basket 53.

The first spray unit 41 may be fixed to the lower portion of the tub 12, more particularly, to an inside of the sump 20, unlike the second spray unit 43 and the third spray unit 43.

The dish washer 1 may include a circulating pump 30 for pumping water stored in the sump 20 to the first to third spray units 41, 42, and 43. Washing water pumped by the circulating pump 30 may be supplied to the first spray unit 41 through an alternating device 200 connected to the circulating pump 30, or may move upward by a duct 100 to be supplied to the second spray unit 42 or the third spray unit 43.

As described above, washing water stored in the sump 20 or washing water entered the inside of the dish washer 1 from the outside may move to the alternating device 200 by the circulating pump 30.

The alternating device 200 may provide washing water to the first spray unit 41 through a first path 61 connected to the first spray unit 41, and provide washing water to the duct 100 through a second path 62 connected to the duct 100.

The alternating device 200 may selectively provide washing water to at least one of the first spray unit 41 or the duct 100.

The first path 61 and the second path 62 may be positioned below the washing chamber C. Washing water may flow to the first spray unit 41 and the duct 100 positioned inside the washing chamber C through the first path 61 and the second path 62.

Washing water may flow to the second spray unit 42 and the third spray unit 43 through the duct 100 (the first spray unit 41, the second spray unit 42, and the third spray unit 43 are also referred to a first rotor, a second rotor, and a third rotor, respectively, however, in the following descriptions, the spray units will be referred to as the first spray unit 41, the second spray unit 42, and the third spray unit 43).

Hereinafter, the alternating device 200 will be described in detail.

Figure 3:
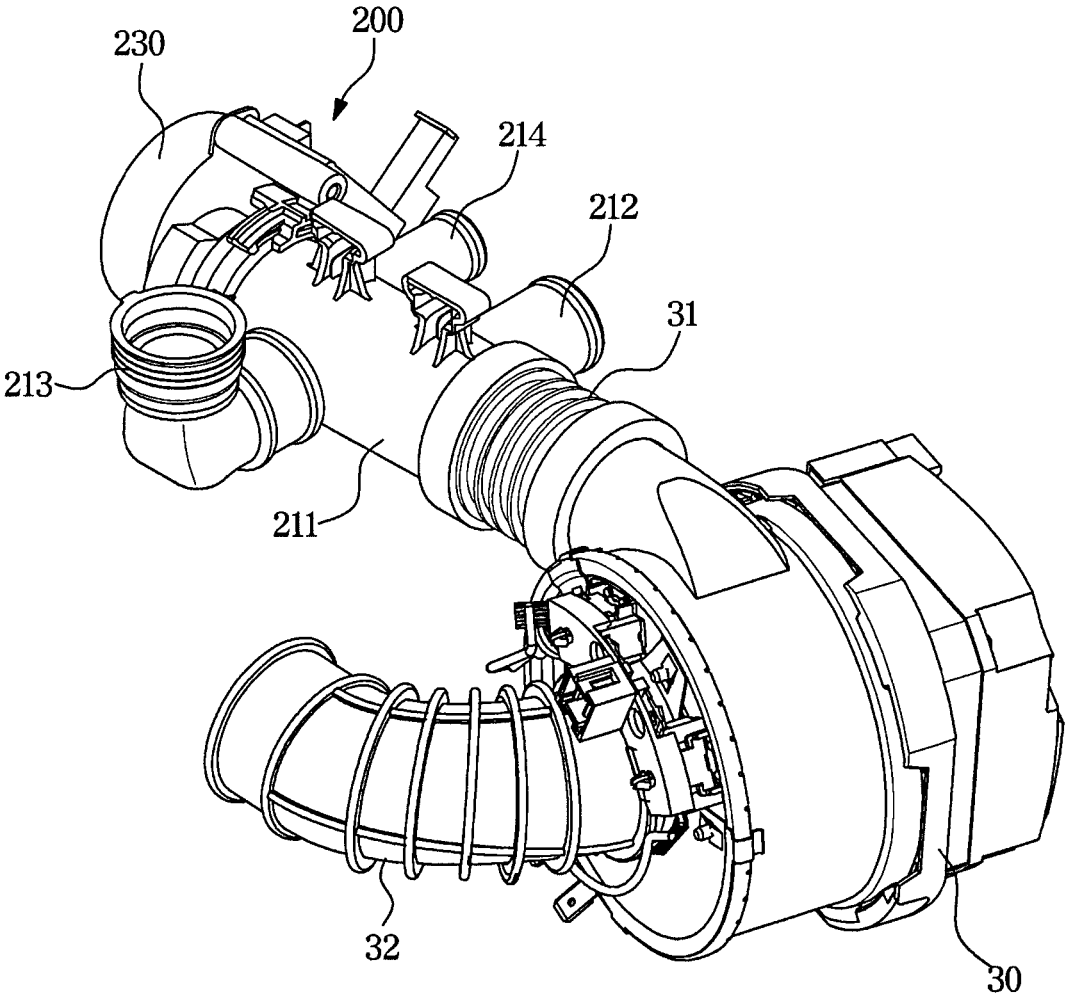
FIG. 3 shows some components of a dish washer according to an embodiment of the disclosure.
Figure 4:
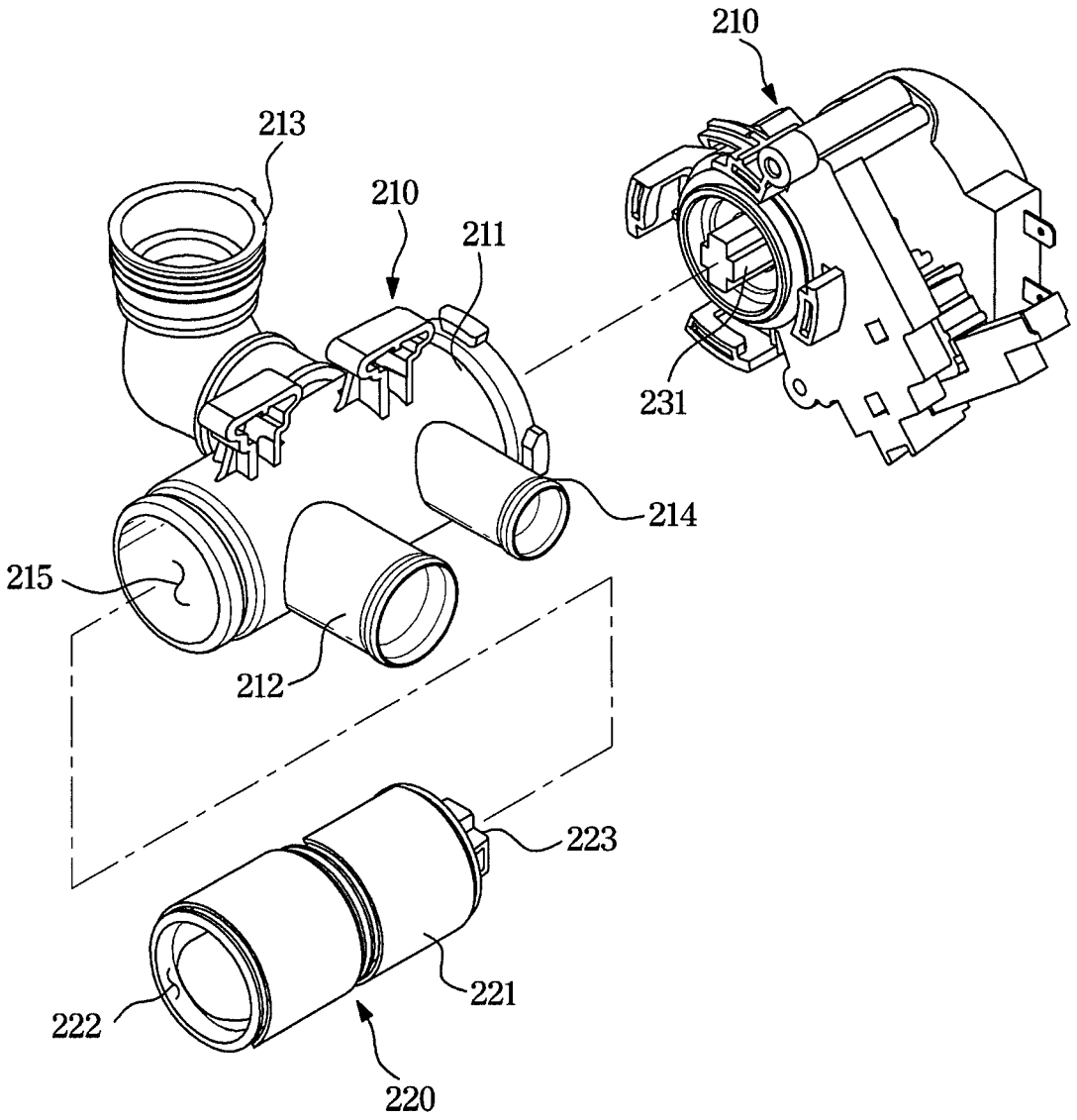
FIG. 4 is an exploded perspective view of an alternating device of a dish washer according to an embodiment of the disclosure.
Figure 5:
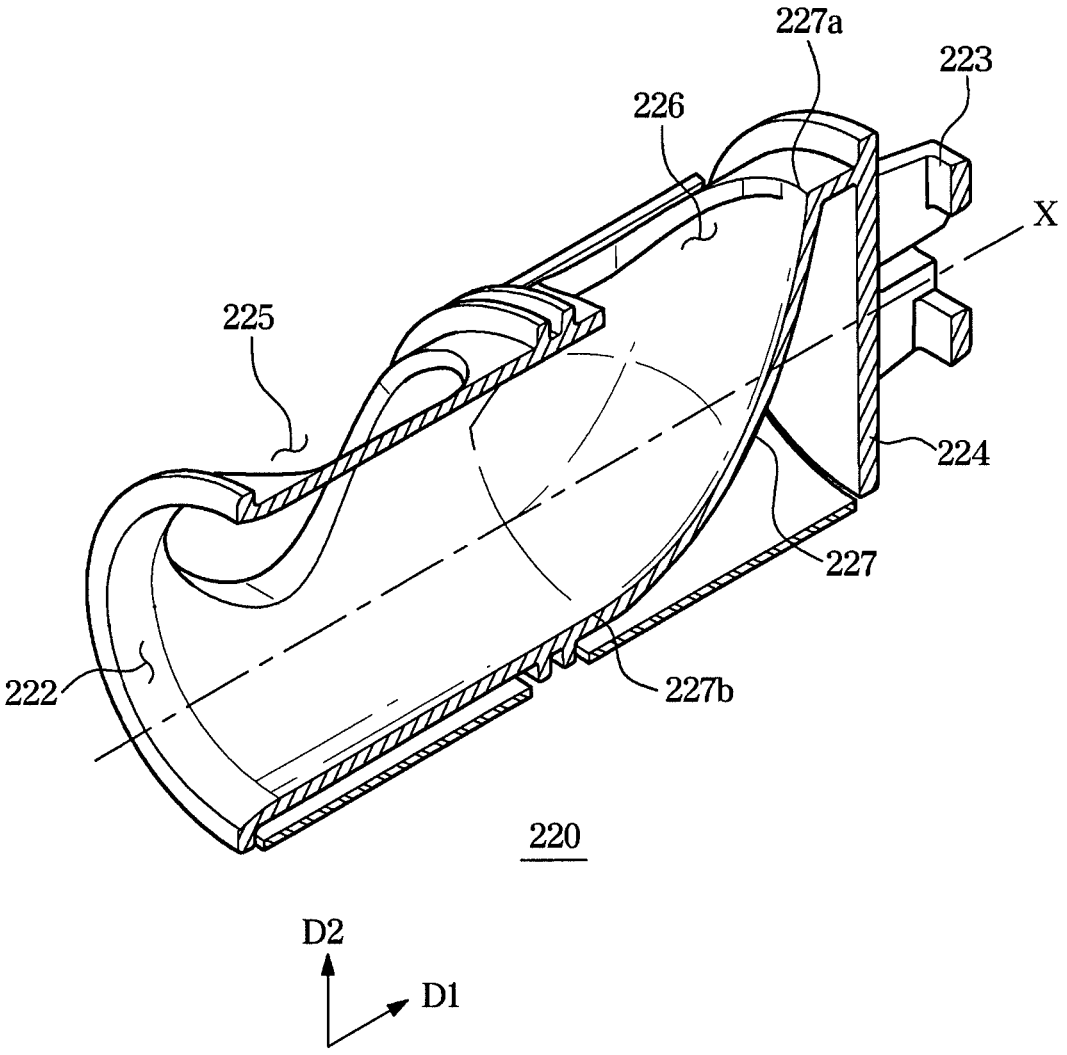
FIG. 5 is a cross-sectional view of a distributor of an alternating device of a dish washer according to an embodiment of the disclosure.
Figure 6:
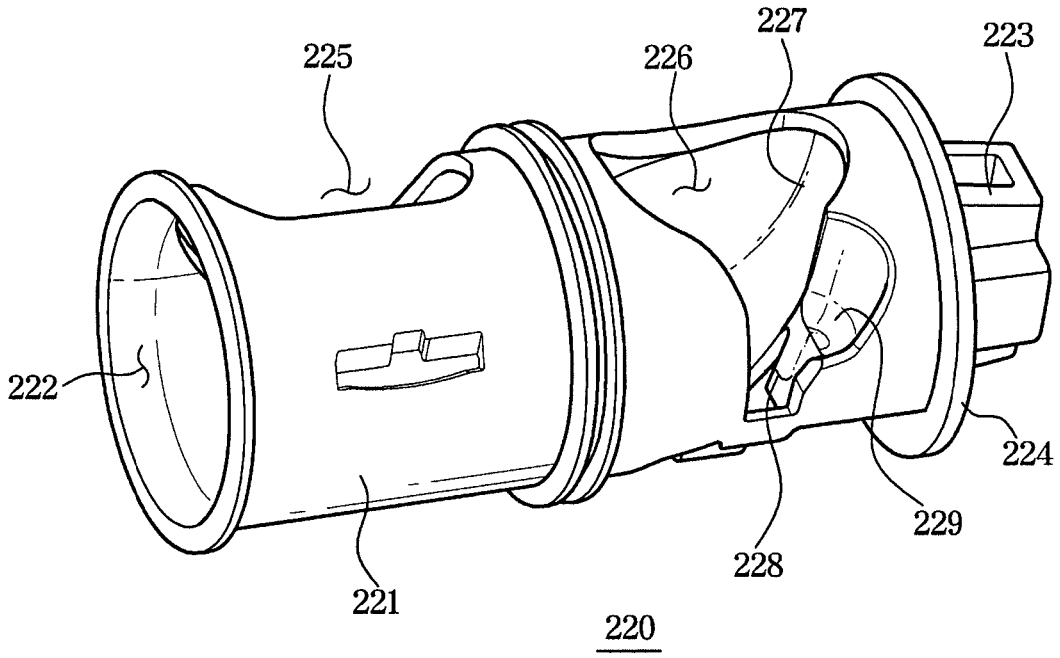
FIG. 6 is a perspective view of a distributor of an alternating device of a dish washer according to an embodiment of the disclosure.
Figure 7:
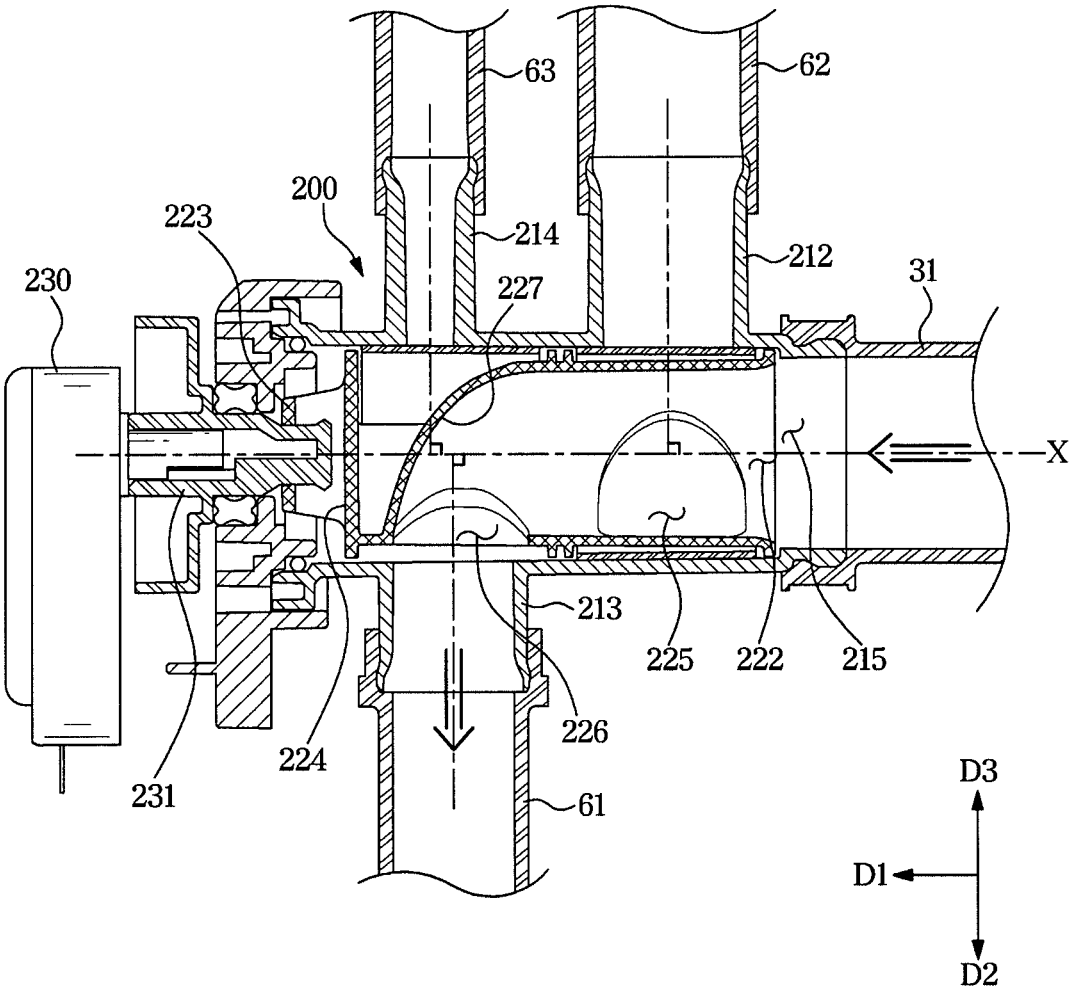
FIGS. 7 to 9 are cross-sectional views of an alternating device and some components of a dish washer according to an embodiment of the disclosure.
Figure 8:
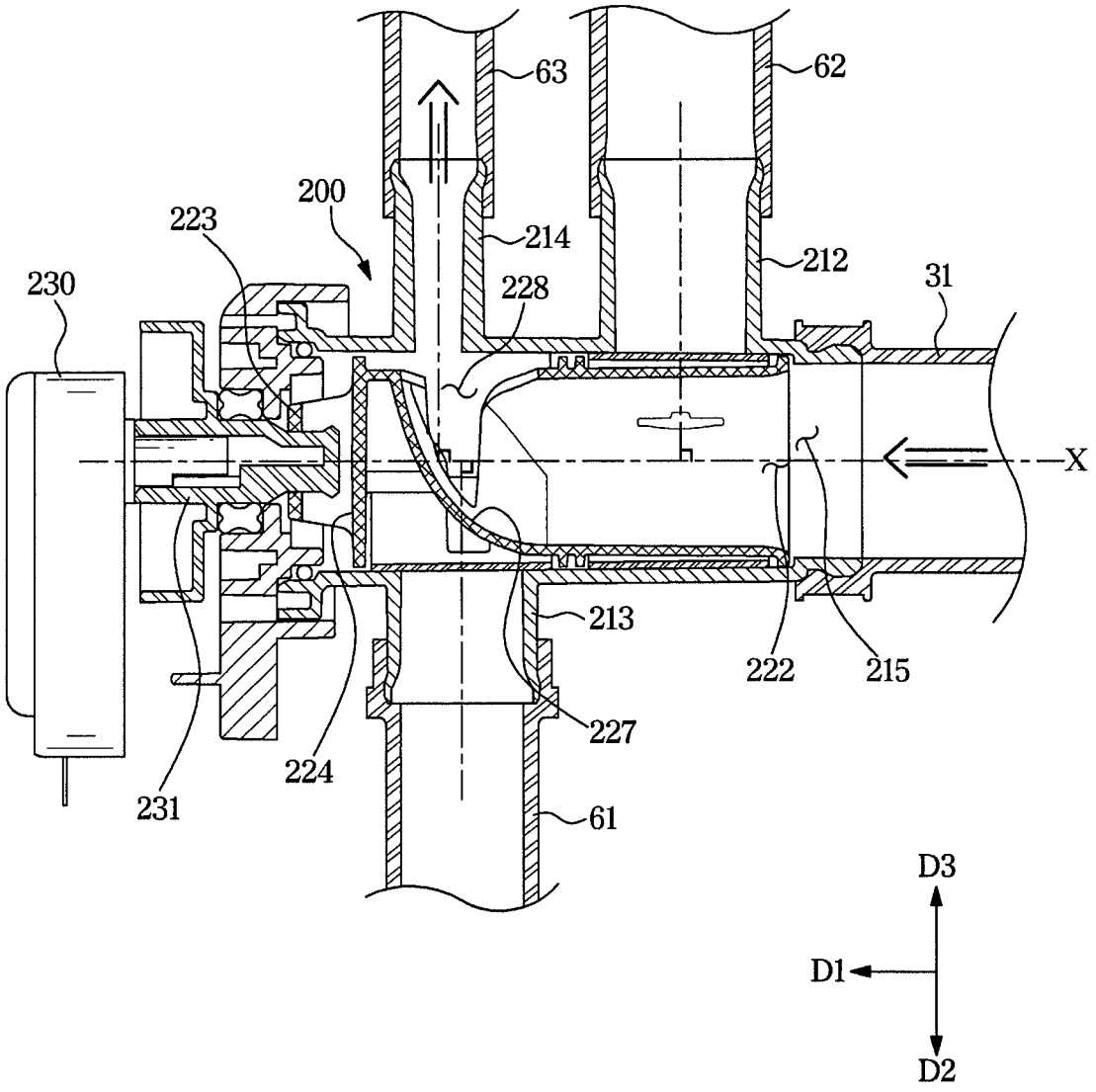
Figure 9:
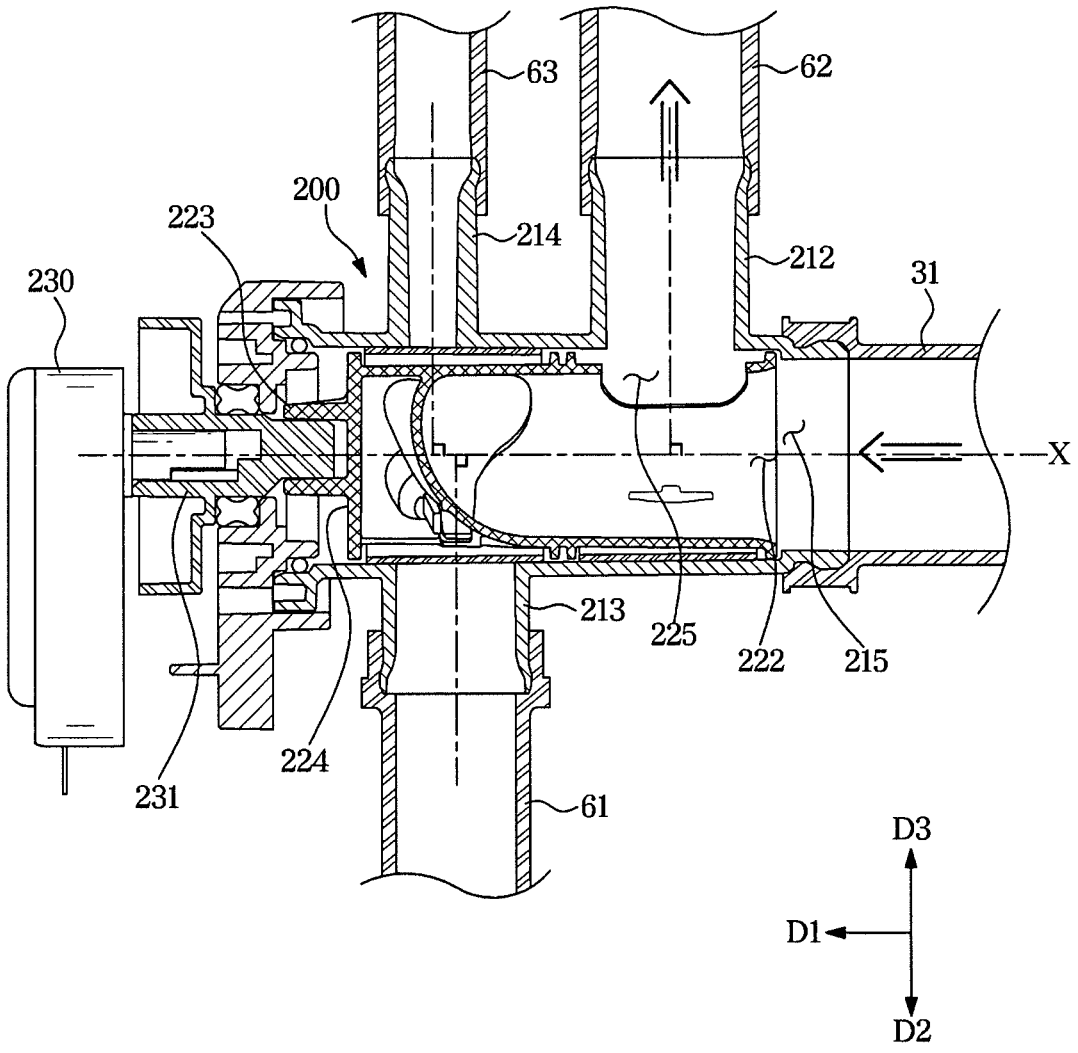

FIG. 3 shows some components of the dish washer according to an embodiment of the disclosure, FIG. 4 is an exploded perspective view of the alternating device of the dish washer according to an embodiment of the disclosure, FIG. 5 is a cross-sectional view of the distributor of the alternating device of the dish washer according to an embodiment of the disclosure, FIG. 6 is a perspective view of the distributor of the alternating device of the dish washer according to an embodiment of the disclosure, and FIGS. 7 to 9 are cross-sectional views of the alternating device and some components of the dish washer according to an embodiment of the disclosure.

As shown in FIGS. 3 and 4, the circulating pump 30 may pump washing water stored in the sump 20 or washing water entered from the outside of the dish washer 1 through a second supply pipe 32, and then transfer the washing water to a first supply pipe 31.

The alternating device 200 may be connected to the first supply pipe 31 to receive the washing water pumped by the circulating pump 31.

The alternating device 200 may include a housing 210 including a communicating portion 215 communicating with the first supply pipe 31 to receive washing water, and a distributor 220 positioned inside the housing 210 and being rotatable on a rotation axis (see FIG. 5) X extending in a direction in which the communicating portion 215 opens, wherein the distributor 220 may be in the shape of a cylinder.

The alternating device 200 may include a motor 230 for providing power for rotating the distributor 220.

A side of the housing 210, which is opposite to the communicating portion 215, may include an opening through which the distributor 220 and the motor 230 are coupled to the housing 210.

The housing 210 may include a cylinder portion 211 formed in the shape of a cylinder, and a first outflow portion 212 disposed at an outer circumference of the cylinder portion 211 to discharge washing water to the second spray unit 42 and the third spray unit 43 through the duct 100.

The housing 210 may include a second outflow portion 213 disposed at the outer circumference of the cylinder portion 211 to discharge washing water to the first spray unit 41. The housing 210 may include the first outflow portion 212 disposed at the outer circumference of the cylinder portion 211 to discharge washing water to the second spray unit 42 or the third spray unit 43 through the duct 100. The housing 210 may include a third outflow portion 214 disposed at the outer circumference of the cylinder portion 211 to discharge washing water to an auxiliary spray unit (not shown).

When a direction in which the communicating portion 215 opens or washing water enters the housing 210 is referred to as a first direction D1, the first outflow portion 212, the second outflow portion 213, and the third outflow portion 214 may open in directions that are orthogonal to the first direction D1.

More specifically, the second outflow portion 213 may open in a second direction D2 that is orthogonal to the first direction D1, and the first outflow portion 212 and the third outflow portion 214 may open in a third direction D3 that is orthogonal to the first direction D1 and that is an opposite direction of the second direction D2.

The first outflow portion 212 may be closer to the communicating portion 215 than the second outflow portion 213 or the third outflow portion 214.

The second outflow portion 213 may be located on the same line as the third outflow portion 214 in a diameter direction of the cylinder portion 211.

Washing water entered the inside of the housing 210 may be discharged to the outside by the distributor 220 through at least one of the first outflow portion 212, the second outflow portion 213, or the third outflow portion 214.

As shown in FIGS. 5 and 6, the distributor 220 may discharge washing water through one of the first outflow portion 212, the second outflow portion 213, or the third outflow portion 214, through at least two of the first outflow portion 212, the second outflow portion 213, or the third outflow portion 214, or through all of the first outflow portion 212, the second outflow portion 213, and the third outflow portion 214.

The distributor 220 may be in the shape of a cylinder and positioned inside the housing 210.

The distributor 220 may include a body portion 221 formed in the shape of a cylinder, an inlet portion 222 positioned in one end of the body portion 221 to correspond to the communicating portion 215, and a rotating portion 223 positioned in the other end of the body portion 221 and coupled to a rotating shaft 231 of the motor 230 to transfer a rotation force to the body portion 221.

As described above, in a portion of the housing 210, which is opposite to the communicating portion 215, an opening may be formed through which the distributor 220 and the motor 230 are coupled to the housing 210, and the rotating portion 223 may be coupled to the motor 230 through the opening of the housing 210 to rotate in one direction or the opposite direction on the rotation axis X inside the housing 210 through a rotational force transferred from the motor 230.

The body portion 221 may include an inside path through which washing water entered through the inlet portion 222 passes. Washing water may enter the inside path of the body portion 221 through the inlet portion 222, and then be discharged to the outside of the distributor 220 through a first distributing hole 225 and a second distributing hole 226 formed in an outer circumference of the body portion 221.

As described above, the distributor 220 may rotate on the rotation axis X inside the housing 210. The first distributing hole 225 may be positioned at a location corresponding to the first outflow portion 212 for a predetermined time when the distributor 220 rotates.

That is, the first distributing hole 225 may be positioned at a location corresponding to the first outflow portion 212 in a radial direction of the body portion 221 with respect to the rotation axis X (see FIG. 9).

When the distributor 220 rotates, the first distributing hole 225 may overlap with the first outflow portion 212 for a predetermined time. At this time, washing water remaining in the inside path of the distributor 220 may be discharged to an outside of the alternating device 200 through the first distributing hole 225 and the first outflow portion 212. The washing water discharged through the first distributing hole 225 and the first outflow portion 212 may move along the second path 62 toward the duct 100 to flow to the second spray unit 42 and the third spray unit 43.

The second distributing hole 226 may be positioned at a location corresponding to the second outflow portion 213 for a predetermined time when the distributor 220 rotates (see FIG. 7).

That is, the second distributing hole 226 may be positioned at a location corresponding to the second outflow portion 213 in the radial direction of the body portion 221 with respect to the rotation axis X.

When the distributor 220 rotates, the second distributing hole 226 may overlap with the second outflow portion 213 for a predetermined time. At this time, washing water remaining in the inside path of the distributor 220 may be discharged to the outside of the alternating device 200 through the second distributing hole 226 and the second outflow portion 213. The washing water discharged through the second distributing hole 226 and the second outflow portion 213 may move along the second path 62 to flow to the first spray unit 41.

Because the second outflow portion 213 and the third outflow portion 214 are located on the same line in the substantially radial direction the cylinder portion 211 with respect to the rotation axis X, the second distributing hole 226 may overlap with the third outflow portion 214 for a predetermined time when the distributor 220 rotates (see FIG. 8).

At this time, washing water remaining in the inside path of the distributor 220 may be discharged to the outside of the alternating device 200 through the second distributing hole 226 and the third outflow portion 214. The washing water discharged through the second distributing hole 226 and the third outflow portion 214 may move along the third path 63 to flow to the first spray unit 41.

The second distributing hole 226 may include an extension portion 228 extending in a circumference direction of the body portion 221 from a circumference of the second distributing hole 226.

There may be a case in which washing water needs to be supplied to both the second outflow portion 213 and the third outflow portion 214. The extension portion 228 may be used to extend a length in circumference direction of the second distributing hole 226.

Particularly, the extension portion 228 may be used to discharge washing water to the third outflow portion 214 when the alternating device 200 supplies washing water to both the second outflow portion 213 and the third outflow portion 214.

Accordingly, the second distributing hole 226 may provide washing water to the second outflow portion 213 or the third outflow portion 214 through a rotation, and also, the second distributing hole 226 may provide washing water simultaneously to both the second outflow portion 213 and the third outflow portion 214 through the extension portion 228.

Also, at least one area of the first distributing hole 225 may be opposite to at least one area of the second distributing hole 226 with respect to the rotation axis X. Accordingly, when the distributor 220 rotates, the first distributing hole 225 and the second distributing hole 226 may provide washing water to both the first outflow portion 212 and the second outflow portion 213 at a predetermined position.

Also, when the distributor 220 rotates, the first distributing hole 225 and the second distributing hole 226 may provide washing water to all of the first outflow portion 212, the second outflow portion 213, and the third outflow portion 214 at a predetermined position.

As shown in FIGS. 7 to 9, when the distributor 220 rotates, the first, second, and third outflow portions 212, 213, and 214 may overlap selectively with the first and second distributing holes 225 and 226 to distribute washing water as necessary.

As described above, the first, second, and third outflow portions 212, 213, and 214 may be orthogonal to the communicating portion 215. Accordingly, a flow direction of washing water entered the alternating device 200 may change to a vertical direction.

When the flow direction of washing water changes to the vertical direction, flow velocity of the washing water may be lowered so that water pressure drops, and accordingly, the capacity of the circulating pump 30 may increase, resulting in a deterioration of efficiency.

To prevent the deterioration of efficiency, the alternating device 200 according to an embodiment of the disclosure may include a guide 227 formed on a path of washing water of which flow direction changes to the vertical direction to guide the flow direction of washing water.

Because the guide 227 is positioned on the path of washing water of which flow direction changes to the vertical direction, the guide 227 may prevent water pressure from dropping due to collision of washing water.

In the case of a typical distributor, to prevent water pressure from dropping, a communicating portion and a plurality of outflow portions are opened or closed toward the substantially same direction, and the distributor positioned between the communicating portion and the plurality of outflow portions is substantially orthogonal to the direction in which the communicating portion and the plurality of outflow portions open to distribute washing water flowing to the plurality of outflow portions.

In this case, because the distributor is orthogonal to the communicating portion, a great physical force is required to drive the distributor due to a collision force with washing water. Therefore, a motor of great capacity needs to be used, and due to collision of the distributor with washing water, water pressure drops.

Accordingly, to efficiently drive a distributor, in an embodiment of the disclosure, an alternating device in which a distributor opens in a direction of a rotation axis X so that washing water enters in the direction of the rotation axis X, and washing water is discharged through the outer circumference of the distributor may be used.

However, when the alternating device is used, the inflow direction of washing water may be orthogonal to the outflow direction of washing water so that water pressure may drop. According to an embodiment of the disclosure, the distributor 220 may include the guide 227 to reduce a drop of water pressure.

The guide 227 may be positioned in the body portion 221 in such a way to be opposite to the inlet portion 222 positioned in one end of the body portion 221.

In the other end 224 of the distributor 220, the rotating portion 223 coupled to the motor 230 may be positioned, and the guide 227 may be positioned in an inner area of the distributor 220 than the rotating portion 223. That is, the guide 227 may be positioned in the inner area of the distributor 220 than the other end 224 of the distributor 220.

The area in which the guide 227 is positioned may be opposite to the inlet portion 222. In the area, the flow direction of washing water may change to the vertical direction so that a largest number of collisions of washing water occur, and accordingly, water pressure most drops.

Particularly, in the area in which the guide 227 is positioned, washing water may be discharged through the second distributing hole 226, and accordingly, water pressure of washing water flowing to the second outflow portion 213 or the third outflow portion 214 through the second distributing hole 226 may drop.

The guide 227 may include a curved surface for guiding washing water to be discharged to the second distributing hole 226, thereby preventing water pressure from dropping. Because the guide 227 formed in the shape of a curved surface is positioned in the area in which the flow direction of washing water changes to the vertical direction, the flow direction of washing water may smoothly change. That is, the curved surface may prevent the inside path from being formed perpendicularly and washing water from colliding perpendicularly with an inner wall of the distributor 220, thereby reducing a drop of water pressure.

The guide 227 may be formed in a concave shape with respect to the inflow direction of washing water, that is, with respect to the inlet portion 222.

At least one portion of one end 227*a* of the guide 227 may be connected to the second distributing hole 226 so that the guide 227 guides washing water to the second distributing hole 226 along the curved surface.

The other end 227*b* of the guide 227 may be connected to a portion of an inner circumference surface of the distributor 220. Accordingly, the guide 227 may guide washing water to the second distributing hole 226 from the inside path of the distributor 220.

The guide 227 may include an auxiliary guide 229 to guide washing water discharged through the extension portion 228. Accordingly, by guiding the entire of washing water through the extension portion 228 as well as the second distributing hole 226, both flow velocity and water pressure may be prevented from dropping.

The guide 227 may guide all of washing water to be discharged to the second outflow portion 213 and washing water to be discharged to the third outflow portion 214 by a rotation of the distributor 220. That is, the guide 227 may guide washing water entered in the first direction D1 toward the second direction D2 or the third direction D3 that is orthogonal to the first direction D1, while reducing collision of the washing water.

Accordingly, washing water provided to the duct 100 and the auxiliary spray unit (not shown) may flow without a great drop of flow velocity and water pressure, thereby increasing efficiency of the dish washer 1.

By providing the curved surface for guiding washing water in an inside area of the alternating device where the flow direction of the washing water changes to the substantially vertical direction, flow velocity loss of washing water that may occur when the flow direction of the washing water changes may be reduced, thereby increasing water circulation efficiency of the dish washer.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A dish washer comprising:

a main body;

a tub positioned inside the main body;

a basket configured to be positioned inside the tub and receive an item to be washed;

a first sprayer and a second sprayer configured to spray water toward the basket;

a circulating pump configured to circulate the water; and an alternating device configured to provide the water from the circulating pump to at least one of the first sprayer or the second sprayer, wherein the alternating device includes:

a housing including a communicating portion communicating with the circulating pump to receive the water, and a distributor rotatably positioned inside the housing and formed in the shape of a cylinder, and the distributor includes:

an inlet portion positioned on one side of the distributor and at a position corresponding to a position of the communicating portion of the housing, at least one distributing hole formed on an outer circumference of the distributor and configured to provide the water to at least the first sprayer or the second sprayer, and a guide positioned on the other side of inside of the distributor and including a curved surface for guiding the water to the at least one distributing hole.

2. The dish washer according to claim 1, wherein the guide is formed in a concave shape with respect to a direction in which the inlet portion opens.

3. The dish washer according to claim 1, wherein the at least one distributing hole is a first distributing hole configured to provide the water to the first sprayer, and the distributor includes a second distributing hole configured to provide the water to the second sprayer, and at least one portion of the curved surface of the guide is connected to the second distributing hole such that the guide guides the water to the second distributing hole.

4. The dish washer according to claim 3, wherein one end of the curved surface of the guide is connected to an inner circumference surface of the distributor, and another end of the curved surface is connected to the second distributing hole.

5. The dish washer of claim 1, wherein the alternating device further comprises a motor configured to rotate the distributor, and the distributor is rotatable on a rotation axis extending in a direction in which the communicating portion opens, and the distributor comprises a rotating portion positioned on an outside surface of the distributor in a direction of the rotation axis and coupled to the motor to rotate the distributor.

6. The dish washer according to claim 5, wherein the housing comprises a connection portion being opposite to the communicating portion and including an opening such that the motor is connected to the rotating portion.

7. The dish washer according to claim 1, wherein the at least one distributing hole is a first distributing hole configured to provide the water to the first sprayer, and the distributor includes a second distributing hole configured to provide the water to the second sprayer, the housing comprises a cylinder portion, a first outflow portion disposed at an outer circumference of the cylinder portion and selectively communicating with the first distributing hole, and a second outflow portion disposed at the outer circumference of the cylinder portion and selectively communicating with the second distributing hole, and the communicating portion is positioned at one end of the cylinder portion.

8. The dish washer according to claim 7, wherein the communicating portion is orthogonal to the first outflow portion or the second outflow portion.

9. The dish washer according to claim 8, wherein the first outflow portion is closer to the communicating portion than the second outflow portion and opposite to the second outflow portion with respect to the cylinder portion.

10. The dish washer according to claim 9, further comprising an auxiliary sprayer configured to spray the water, and the housing further comprises a third outflow portion configured to provide the water to the auxiliary sprayer and disposed at the outer circumference of the cylinder portion.

11. The dish washer according to claim 10, wherein the third outflow portion is positioned on the same line as the second outflow portion in a diameter direction of the cylinder portion with respect to the rotation axis.

12. The dish washer according to claim 10, wherein the second distributing hole comprises an extension portion extending in a circumference direction of the cylinder portion from a circumference of the second distributing hole.

13. The dish washer according to claim 12, wherein the guide portion further comprises an auxiliary guide portion guiding the water such that the water is discharged to the third outflow portion through the extension portion.

14. The dish washer according to claim 10, wherein the guide guides the water flowing through the inlet portion such that the water is discharged to the third outflow portion through the second distributing hole.

15. An alternating device for a dishwasher configured to supply water to at least one of a first sprayer or a second sprayer configured to spray the water, the alternating device comprising:

a housing comprising a communicating portion opening in a first direction to receive the water, a first outflow portion opening in a second direction that is orthogonal to the first direction to discharge the water to the first sprayer, and a second outflow portion opening in the second direction that is orthogonal to the first direction to discharge the water to the second sprayer; and a distributor rotatably positioned inside the housing and configured to provide the water to at least one of the first outflow portion or the second outflow portion, wherein the distributor comprises, an inlet portion formed on one side of the distributor and corresponding to the communicating portion, at least one distributing hole overlapping with at least one of the first outflow portion or the second outflow portion by a rotation of the distributor, and a guide formed on the other side of inside of the distributor and guiding the water entered through the inlet portion to the distributing hole.

16. The alternating device according to claim 15, wherein the at least one distributing hole opens in the second direction, and the guide includes a curved surface extending from the first direction to the second direction to guide the water entered in the first direction toward the second direction.

17. The alternating device according to claim 16, wherein the housing further comprises a third outflow portion opening in a third direction that is an opposite direction of the second direction to discharge the water, and the curved surface of the distributor guides the water entered in the first direction toward the third direction.

18. The alternating device according to claim 16, wherein a third outflow portion is positioned on the same line as the second outflow portion in a diameter direction of the distributor.

19. The alternating device according to claim 18, wherein the distributor is formed in the shape of a cylinder, the at least one distributing hole comprises a first distributing hole formed in an outer circumference of the distributor and positioned at a location corresponding to the first outflow portion for a first predetermined time when the distributor rotates, and a second distributing hole positioned at a location corresponding to at least one of the second outflow portion or the third outflow portion for a second predetermined time when the distributor rotates.

20. A distributor of an alternating device for a dishwasher configured to selectively distribute water, the distributor rotating on a rotation axis extending in a first direction, the distributor comprising:

an inlet portion formed on one side of the distributor with respect to the first direction and having an opening in the first direction to receive the water;

a distributing hole opening in a second direction that is orthogonal to the first direction and distributing the water to at least one sprayer; and a guide positioned inside the distributor opposite to the inlet portion along the first direction, and the guide including a curved surface extending along the first direction to the second direction to guide the water that flows along the first direction toward the second direction.

* * * * *